US008936335B2

(12) United States Patent
Fukuda

(10) Patent No.: US 8,936,335 B2
(45) Date of Patent: Jan. 20, 2015

(54) LIQUID EJECTING APPARATUS AND METHOD OF CONTROLLING LIQUID EJECTING APPARATUS

(71) Applicant: Seiko Epson Corporation, Tokyo (JP)

(72) Inventor: Shunya Fukuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/205,869

(22) Filed: Mar. 12, 2014

(65) Prior Publication Data

US 2014/0285547 A1 Sep. 25, 2014

(30) Foreign Application Priority Data

Mar. 22, 2013 (JP) ..... 2013-059575
Jan. 22, 2014 (JP) ..... 2014-009251

(51) Int. Cl.
*B41J 29/38* (2006.01)
*B41J 2/165* (2006.01)

(52) U.S. Cl.
CPC ..... *B41J 2/1652* (2013.01); *B41J 2/16505* (2013.01)
USPC ..... 347/9; 347/7; 347/14; 347/23

(58) Field of Classification Search
CPC .... B41J 2/1652; B41J 2/16505; B41J 2/1707; B41J 2/1714
USPC ..... 347/7, 9, 14, 19, 23
See application file for complete search history.

(56) References Cited

U.S. PATENT DOCUMENTS 7,159,963 B2 * 1/2007 Nishino ..... 347/33

FOREIGN PATENT DOCUMENTS

JP 2002-144548 5/2002

* cited by examiner

*Primary Examiner* — Juanita D Jackson
(74) *Attorney, Agent, or Firm* — Workman Nydegger

(57) ABSTRACT

There is provided a flush box in an area other than a recording area in an end portion of a range in which a recording head can be driven in a main scanning direction. A control circuit performs control such that it is determined whether or not a flag is turned on for flushing operation in step S3; in a case where the flag is turned on, in step S4, it is determined whether final path is already finished or is about to be finished; when it is determined that the recording head is on the final path, in step S5, it is determined whether or not the stop position is on the side of the flush box. Then, maintenance operation is started in step S6 and paper feeding operation is executed in step S7 only when the stop position is on the side of the flush box. In addition, only the paper feeding operation is executed in step S7 when the stop position is on a side opposite to the side of the flush box.

4 Claims, 5 Drawing Sheets

LIQUID EJECTING APPARATUS AND METHOD OF CONTROLLING LIQUID EJECTING APPARATUS

The present application claims priority to Japanese Patent Application No. 2013-059575 filed on Mar. 22, 2013 and Japanese Patent Application No. 2014-009251 filed on Jan. 22, 2014, which applications are hereby incorporated by reference in its entirety.

BACKGROUND

1. Technical Field

The present invention relates to a liquid ejecting apparatus which performs a liquid ejecting operation of ejecting a liquid onto a landing target and a method of controlling the liquid ejecting apparatus. In particular, the invention relates to a liquid ejecting apparatus capable of executing a maintenance operation separately from the liquid ejecting operation and a method of controlling the liquid ejecting apparatus.

2. Related Art

In the related art, JP-A-2002-144548 discloses an ink jet printing apparatus as a liquid ejecting apparatus performing a flushing operation as a maintenance operation. JP-A-2002-144548 discloses that a flush box that receives an ink discharged from a recording head is disposed in an area other than a recording area in a movable range of an ink jet type recording head (hereinafter, recording head) as a type of a liquid ejecting head in a main scanning direction, that is, in a position deviated from an area in which a printing operation (liquid ejecting operation) is performed on a printing medium (recording medium) in the main scanning direction, and the flushing operation is executed in a state where the recording head faces the flush box. The flushing operation ejects an ink through nozzles to the flush box a predetermined number of times to discharge a thickened ink within the ink head (in particular, in the vicinity of the nuzzle) separately from the liquid ejecting operation (recording operation) for recording an image or the like on a recording medium for the intended use of the ink jet printing apparatus.

In general, since the recording head is moved above the flush box deviated from the recording area to perform the flushing operation in the position, the flushing operation is not simultaneously performed with the recording operation on a recording medium, and therefore, the recording operation needs to be interrupted during the period. In addition, if the recording head is positioned on a side where the flush box is not provided, that is, on a side opposite to the flush box in the main scanning direction, the recording head is moved to a side where the flush box is provided to perform the flushing operation after being moved. It takes time for such movement, resulting in increase of an interruption period of the recording operation.

In addition, in order to shorten the interruption period of the above-described recording operation as much as possible, a configuration is also proposed in which the flushing operation is performed between transporting operations between an operation where a recording medium is discharged from the liquid ejecting apparatus after finishing the recording operation on the recording medium and an operation where a new recording medium is supplied to a stage (platen) on which the recording operation is performed (also referred to as flushing between pages). However, there is a case where the flushing operation required for discharging the thickened ink is not completed during the transporting operation. In addition, if the flushing operation is executed every time between the pages, the interruption period of the recording operation becomes as long as that period. As a result, throughput of the process of the entire recording operation is reduced.

Such a problem also exists in other liquid ejecting apparatuses capable of executing the maintenance operation ejecting a liquid to a liquid receiving part separately from the liquid ejecting operation as original use of the liquid ejecting apparatus as well as in the ink jet printing apparatus equipped with the recording head ejecting an ink.

SUMMARY

An advantage of some aspects of the invention is that it provides a liquid ejecting apparatus that shortens an interruption period of the liquid ejecting operation and a method of controlling the liquid ejecting apparatus.

According to an aspect of the invention, a liquid ejecting apparatus executes liquid ejecting operation ejecting a liquid through nozzles of a liquid ejecting head onto a landing target while the liquid ejecting head scans in a first direction and the landing target is transported in a second direction substantially orthogonal to the first direction, in which a liquid receiving part is disposed in an end portion in a movable range of the liquid ejecting head in the first direction and a maintenance operation ejecting a liquid through the nozzles toward the liquid receiving part is executed separately from the liquid ejecting operation, and in which in a period between completion of a final scan of a first landing target and start of the liquid ejecting operation on a second landing target which is transported after the first landing target, the maintenance operation is executed when the liquid receiving part is positioned in a destination of the liquid ejecting head during the final scan of the first landing target and the maintenance operation is not executed when the liquid receiving part is not positioned in the destination of the liquid ejecting head during the final scan.

In this configuration, since the maintenance operation is performed only when the liquid receiving part is positioned in the destination of the liquid ejecting head during the final scan of the first landing target in the period between the completion of the final scan of the first landing target and the start of the liquid ejecting operation on the second landing target which is transported after the first landing target, operation of moving the liquid ejecting head to the liquid receiving part is not performed only for the maintenance operation. For this reason, it is possible to shorten the interruption period of the liquid ejecting operation compared to the configuration of executing the maintenance operation every time the final scan is finished regardless of the destination of the liquid ejecting head.

It is preferable that a configuration of changing the total discharging amount of a liquid in the maintenance operation according to the lapse of time from the completion of the previous maintenance operation to the start of the next maintenance operation be employed.

It is preferable that the total discharging amount of a liquid in the maintenance operation be relatively small when the operation time is relatively short and the total amount of liquid discharged in the maintenance operation be relatively large when the operation time is relatively long.

In this case, it is possible to restrict wasteful consumption of the liquid in the maintenance operation.

According to another aspect of the invention, a method of controlling a liquid ejecting apparatus that executes liquid ejecting operation ejecting a liquid through nozzles of a liquid ejecting head onto a landing target while the liquid ejecting head scans in a first direction and the landing target is transported in a second direction substantially orthogonal to the first direction, in which a maintenance operation ejecting a liquid through the nozzles toward a liquid receiving part disposed in an end portion in a movable range of the liquid ejecting head in the first direction is executed separately from the liquid ejecting operation, and in which in a period between completion of a final scan of a first landing target and start of the liquid ejecting operation on a second landing target which is transported after the first landing target, the maintenance operation is executed when the liquid receiving part is positioned in a destination of the liquid ejecting head during the final scan of the first landing target and the maintenance operation is not executed when the liquid receiving part is not positioned in the destination of the liquid ejecting head during the final scan.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the drawings.

Figure 1:
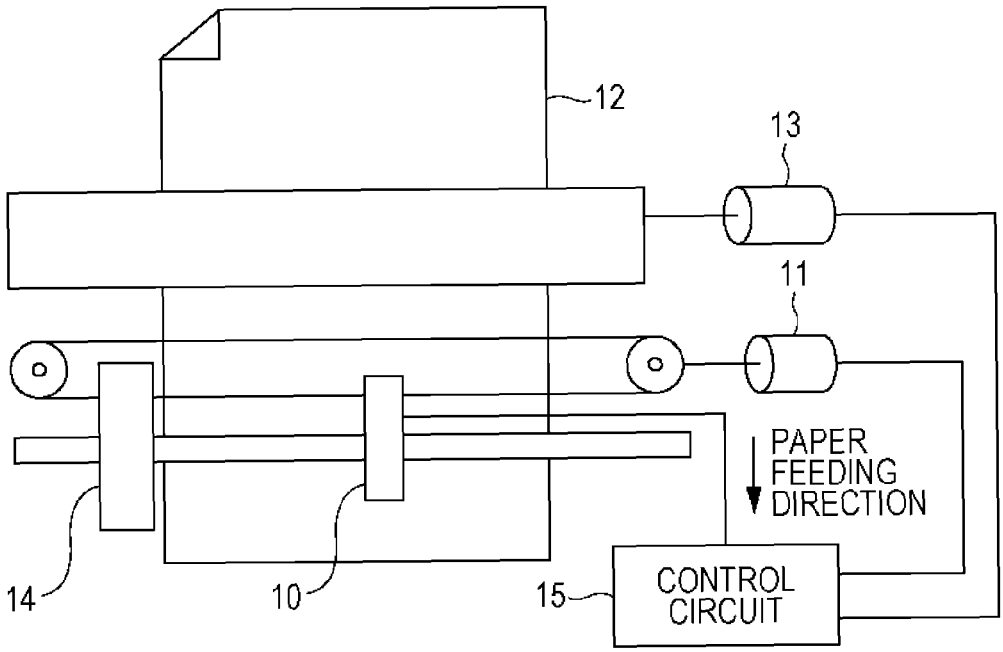
FIG. 1 is a configuration view schematically illustrating an ink jet printer as a type of a liquid ejecting apparatus.

FIG. 1 is a configuration view schematically illustrating an ink jet printer as a type of a liquid ejecting apparatus of the invention. A recording head as a type of a liquid ejecting head in the invention and a direction (scanning direction) of driving the same will be described with reference to FIG. 1.

A recording head 10 is appropriately reciprocated (scanned) in a width direction substantially orthogonal to (intersecting with) a paper feeding direction (transporting direction) of a recording medium 12 (a landing target of an ink as a type of a liquid), such as recording paper, using a carriage motor 11. A predetermined quantity of recording media 12 is fed in a longitudinal direction at a predetermined timing by a platen motor 13. Here, a driving direction in the width direction due to the carriage motor 11 is a main scanning direction (corresponding to a first direction in the invention) and a driving direction in a longitudinal direction due to the platen motor 13 (transporting direction of the recording medium 12) is a sub-scanning direction (corresponding to a second direction in the invention).

The recording head 10 can be driven in a predetermined movable range in the main scanning direction and can perform recording operation (liquid ejecting operation) by making a surface where nozzles (not shown) are formed to face the recording medium. The area where the recording operation is performed is called a recording area (printing area) and the liquid ejecting apparatus is provided with a flush box 14 (corresponding to a liquid receiving part in the invention) in a portion of area where the recording operation cannot be performed, that is, in an area other than the recording area. The recording head 10, the carriage motor 11 and the platen motor 13 are electrically connected to a control circuit 15 and executes a predetermined operation based on a control signal from the control circuit 15.

Flushing operation as a type of maintenance operation can be executed in a position where the recording head 10 faces the flush box 14. The control circuit 15 monitors a status of recording operation (printing status) while executing a predetermined control process. For example, the control circuit determines whether there is any nozzle through which an ink is not discharged (ejected) over a certain period of time. If the ink is not discharged over the certain period of time, the ink inside the nozzle is dried and thickened, thereby causing discharge failure. For this reason, the ink is discharged by making a nozzle, through which it is not necessary to discharge an ink based on recording data (printing data), to face the flush box 14 before such a failure. The flush box 14 needs to be in an area which is not covered by a recording medium 12 on a platen (a stage supporting a recording medium 12 on which the recording operation is performed) and is positioned in a place where the recording operation cannot be performed. Although the area is an area where the recording head 10 is movable, the flushing operation in the area is performed separately from the recording operation on a recording medium 12, thereby impairing the performance of the recording operation. Therefore, in general, the flush box 14 is provided only in an end of the movable area of the recording head.

Figure 2:
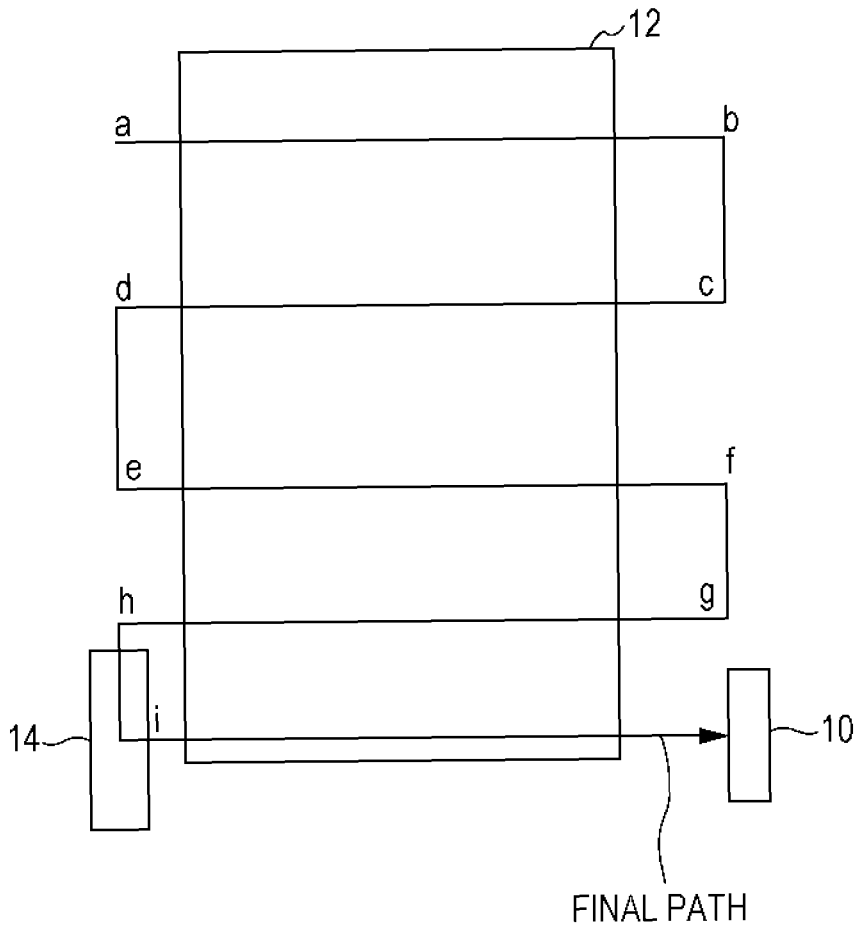
FIG. 2 is a view illustrating relative movement of a recording head on a recording medium.

FIG. 2 is a view illustrating relative movement of the recording head 10 on the recording medium 12.

When performing recording operation on the recording medium 12, the recording head 10 is reciprocated several times in a width direction as a main scanning direction of the recording medium 12 due to the carriage motor 11, and the recording medium 12 is driven (that is, sequentially transported) to a paper discharging side (upper side in FIG. 2) in the sub-scanning direction only by a predetermined distance due to the platen motor 13 every time the recording operation in a forward route and a backward route is finished. The movement of the recording head 10 on the recording medium 12 is as shown in FIG. 2, considering the driving in the main scanning direction and the sub-scanning direction as relative movement of the recording head 10 on the recording medium 12.

In FIG. 2, the recording operation on the recording medium 12 is finished by a movement (a) from a left end to a right end in the main scanning direction, a movement (b) in the sub-scanning direction, a movement (c) from the right end to the left end in the main scanning direction, a movement (d) in the sub-scanning direction, a movement (e) from the left end to the right end in the main scanning direction, a movement (f) in the sub-scanning direction, a movement (g) from the right end to the left end in the main scanning direction, a movement (h) in the sub-scanning direction, and a movement (i) from the left end to the right end in the main scanning direction.

Each movement (scan) of the recording head 10 in the main scanning direction is called a path. A first path (first scan) is started from a in the left end and the final movement (i) from the left end to the right end in the main scanning direction is called a final path (final scan). In a case of the recording operation shown in FIG. 2, the recording head 10 moves to the right end when the final path is finished and is not positioned in the left end where the flush box 14 is disposed.

Figure 3:
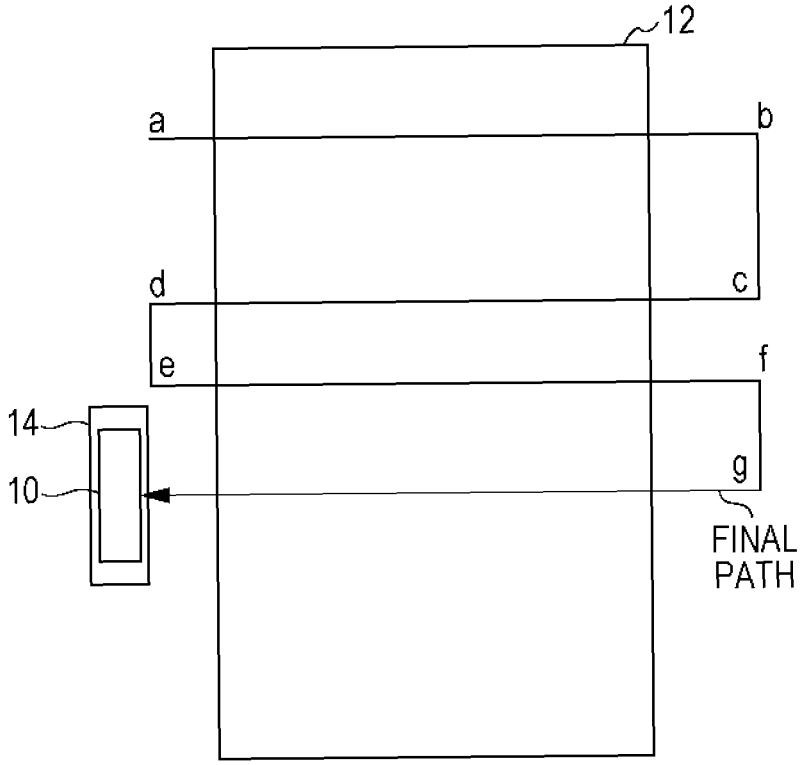
FIG. 3 is a view illustrating another relative movement of a recording head on a recording medium.

FIG. 3 is a view illustrating another relative movement of the recording head 10 on the recording medium 12.

In FIG. 3, the recording operation on the recording medium 12 is finished by a movement (a) from a left end to a right end in the main scanning direction, a movement (b) in the sub-scanning direction, a movement (c) from the right end to the left end in the main scanning direction, a movement (d) in the sub-scanning direction, a movement (e) from the left end to the right end in the main scanning direction, a movement (f) in the sub-scanning direction, and a movement (g) from the right end to the left end in the main scanning direction.

In a case of the recording operation, the recording head 10 moves to the left end when the final path is finished and is positioned in the left end where the flush box 14 is disposed.

In this manner, whether the recording head 10 is positioned in the left end where the flush box 14 is disposed when the final path is finished depends on the recording data and on an accidental factor.

Figure 4:
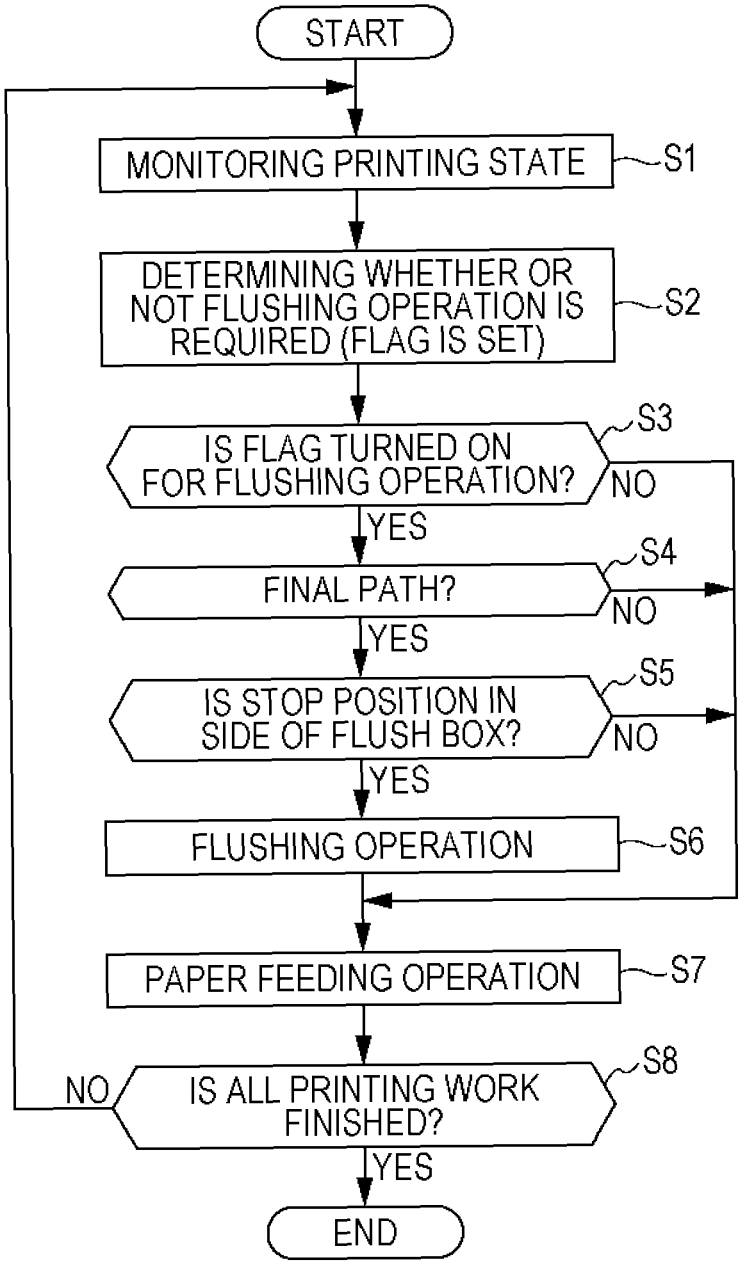
FIG. 4 is a flowchart corresponding to control of an ink jet printer.

FIG. 4 is a flowchart corresponding to control of an ink jet printer.

A CPU or the like (not shown) is equipped inside the control circuit 15 which executes a process corresponding to the flowchart shown in FIG. 4. When the recording medium 12 is fed on the platen and the recording operation on the recording medium 12 is started, the printing status (recording status) is monitored in step S1. Specifically, the status of use is managed for every nozzle. Although various management techniques can be employed, an employed technique may be able to, at least, manage data corresponding to a period while the nozzles are not in use from the final use (that is, at the time of final ink discharge) to the present time. The data is not limited to time and may be indirectly represented by the period using the number of paths or the like. In step S2, it is determined whether or not the flushing operation is necessary based on the above-described recording operation status. It may be determined whether or not the period while the nozzles are not in use exceeds a certain threshold value though the threshold value also depends on properties of an ink. Then, if there is a corresponding nozzle, it is determined that it is necessary to perform the flushing operation for the nozzle and a flag is turned on. If there is no corresponding nozzle, it is determined that it is unnecessary to perform the flushing operation and the flag is kept turned off.

In step S3, it is determined whether or not the flag is turned on for the flushing operation. If the flag is turned off (No), the flushing operation is unnecessary as a matter of course. In this case, the process enters step S7 instead of steps S4 to S6. The process of step S7 will be described later. Meanwhile, even if the flag is turned on, it is not always necessary to perform the flushing operation immediately. In a case where the flag is turned on (Yes), in step S4, it is determined whether the final path is already finished or is about to be finished. Either timing after the final path is finished or timing where the final path is about to be finished may be fine as timing for determination. In a case where it is determined that the recording head is not on the final path yet (No), the process enters step S7. In contrast, if it is determined that the recording head is on the final path (Yes), in step S5, it is determined whether or not the stop position of the recording head 10 is on the side of the flush box 14. In a case where it is determined that the stop position of the recording head 10 is on a side opposite to the flush box 14, the process enters step S7 without performing the flushing operation. In contrast, in a case where it is determined that the stop position of the recording head 10 is on the side of the flush box 14, the flushing operation is started in step S6.

In FIG. 3, the recording head 10 stops on the side of the flush box 14 when the final path is finished. In addition, if there is any nozzle requiring the flushing operation, the flushing operation is started in step S6. That is, it is determined only once in step S5 whether the stop position of the recording head 10 is on the side of the flush box 14 when the final path is finished, and the flushing operation is started in step S6. In the flushing operation, an ink is discharged from a nozzle for which a flag is turned on toward the flush box 14 only a predetermined number of times. The flushing operation progresses simultaneously with paper feeding operation in step S7. The paper feeding operation transports the recording medium 12 only by a predetermined distance prior to the next path when the final path is not finished (the recording medium 12 is not discharged from a printer). In addition, paper feeding and discharging operation discharges the recording medium 12 on which the recording operation is completed from the printer when the final path is finished and supplies a new recording medium 12 on the platen when there is recording data corresponding to the next recording medium 12 (next page). The flushing operation is performed during a period after the final path of the recording operation on a previous recording medium 12 is finished until the recording operation on the next recording medium 12 is started, or is performed after the completion of the entire recording operation job.

With respect to the above, in the example shown in FIG. 2, since the recording head 10 stops on the side where there is no flush box 14 when the final path is finished, it is determined as No in step S5, the flushing operation is not started, and the recording head 10 is not operated to move to the side of the flush box 14 by driving the carriage motor 11 only for the flushing operation. That is, in step S5 where it is determined whether or not the stop position of the recording head 10 is on the side of the flush box 14, it is determined that the recording head is not on the side of the flush box 14 at the time where the final path I is finished, and therefore, only paper feeding operation in step S7 is performed without performing the flushing operation.

That is, during the reciprocal scan of the recording head 10, if the flush box 14 is positioned in the destination of the final path on the recording medium 12, the flushing operation is performed together with the paper feeding operation, and if the flush box 14 is not positioned in the destination of the final path, only the paper feeding operation is performed without performing the flushing operation. There are substantially many forms of control which perform such control.

In this example, step S4 corresponds to means for determining whether or not the reciprocal driving of the recording head 10 is on the final path on the recording medium 12; step S5 corresponds to means for determining whether or not the destination of the recording head 10 is on the side where the flush box 14 is positioned; and step S6 corresponds to means for allowing the flushing operation in a case where the destination of the recording head 10 is on the side where the flush box 14 is positioned when it is determined that the recording head is on the final path and for inhibiting the flushing operation in a case where the destination of the recording head 10 is on the side where the flush box 14 is not positioned when it is determined that the recording head is on the final path. Moreover, the control circuit 15 in the embodiment functions as means described above. The flow of the series of processes also corresponds to a flushing method.

Then, if the flushing operation in step S6 and the paper feeding operation in step S7 are completed, it is subsequently determined whether the entire recording operation (recording operation job) is finished based on the recording data in step S8. That is, if the recording operation on a sheet of the recording medium 12 is completed when the recording data is covered in a sheet of the recording medium 12, it is determined that the recording operation is finished (Yes), and then, the series of processes are finished. In addition, if the recording operation on a plurality of recording media 12 is completed when the recording data is over the plurality of sheets of recording media 12, it is determined that the recording operation is finished (Yes), and then, the series of processes are finished. In contrast, in a case where it is determined that the entire recording operation is not yet completed based on the recording data, the process returns to step S1 to repeat the following processes on a new recording medium 12.

In this manner, during the paper feeding and discharging operation, the flushing operation is performed only when the flush box 14 is positioned in the destination of the recording head 10 on the final path on the previous recording medium 12, and therefore, the operation of moving the recording head 10 to the flush box 14 only for the flushing operation is not performed. For this reason, it is possible to shorten the interruption period of the recording operation compared to in the configuration where the flushing operation is executed every time the final path is finished regardless of the destination of the recording head 10. For this reason, it is possible to control the reduction of the throughput of the entire process of the ink jet printer.

Figure 5:
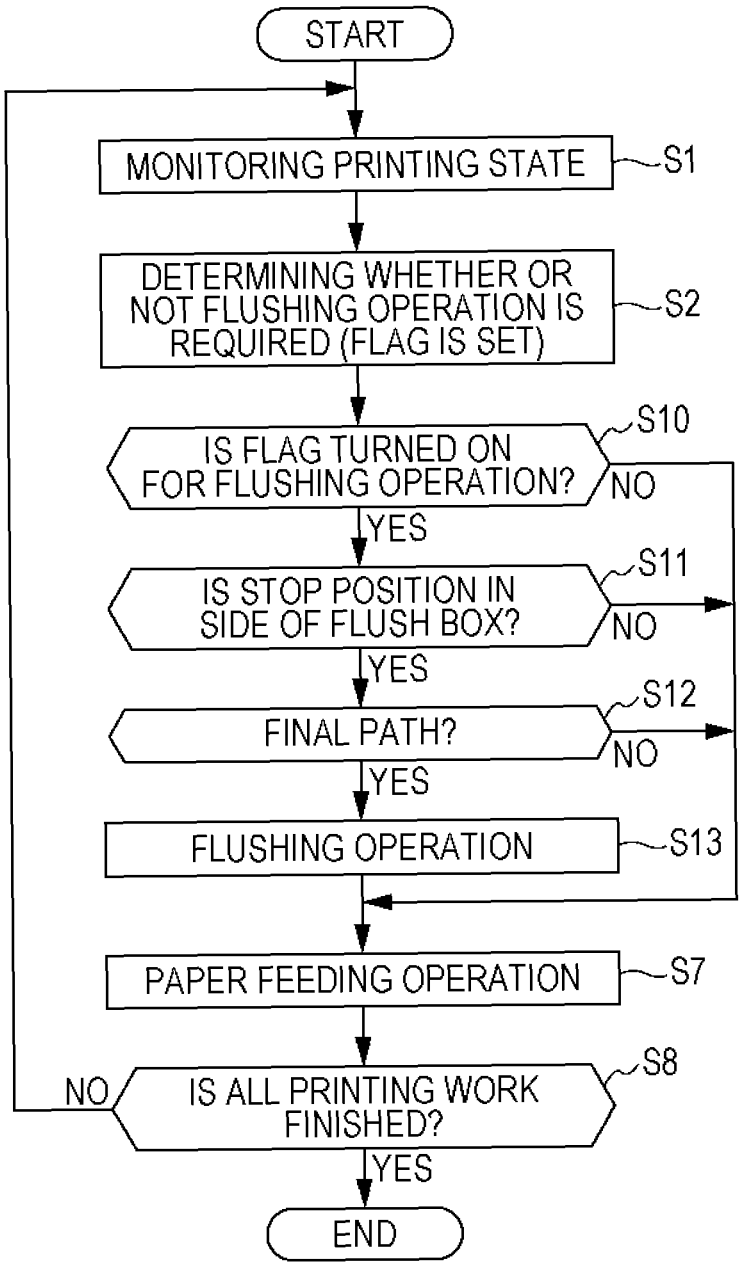
FIG. 5 is a flowchart corresponding to a modification example of control of an ink jet printer.

FIG. 5 is a flowchart corresponding to a modification example of control of an ink jet printer.

Step S1 and step S2 as the control of whether or not to set the flag, step S7 as the paper feeding operation, and step S8, in which it is determined whether or not to finish the recording operation, are the same as the control in FIG. 4. In this example, it is determined whether or not the flag is turned on for the flushing operation in step S10. Even if the flag is turned on, it is not always necessary to perform the flushing operation immediately. In a case where the flag is turned on (Yes), in step S11, it is first determined whether or not the stop position of the recording head 10 is on the side of the flush box 14. Then, in step S12, it is determined whether the final path is already finished or is about to be finished only when the stop position of the recording head 10 is on the side of the flush box 14. Then, the flushing operation is started in step S13 and the paper feeding operation is performed in step S7 only when the recording head is on the final path.

In the example shown in FIG. 3, the respective stop positions are determined when the paths a, c, e, and g are finished, and the recording head is on the side of the flush box 14 when the paths c and g are finished. Therefore, it is determined whether or not the recording head is on the final path in step S12. Then, since the recording head is on the final path only when the path g is finished, the flushing operation and the paper feeding operation are executed in step S13 and step S7, respectively.

With respect to the above, in the example shown in FIG. 2, the respective stop positions are determined when the paths a, c, e, g, and i are finished, and the recording head is on the side of the flush box 14 when the paths c and g are finished. Therefore, it is determined whether or not the recording head is on the final path in step S12. However, since the recording head is not on the final path when the paths c and g are finished, only the paper feeding operation is performed in step S7 while the process does not reach step S13 and the flushing operation is not started.

In this example, step S11 corresponds to means for determining whether or not the stop position of the recording head 10 is on the side where the flush box 14 is positioned; step S12 corresponds to means for determining whether or not the reciprocal driving of the recording head 10 is finished on the final path; and step S13 corresponds to means for allowing the flushing operation when it is determined that the stop position of the recording head 10 is on the side where the flush box 14 is positioned and the final path is finished. Moreover, the control circuit 15 in the embodiment functions as means described above. The flow of the series of processes also corresponds to the flushing method.

However, it is considered that next flushing operation is executed in a short period of time compared to the previous flushing operation when the amount of recording data per sheet of the recording medium 12 is small. That is, in a case where the amount of recording data per sheet of the recording medium 12 is small, the ratio of an ink consumed for the flushing operation increases with respect to an ink consumed for the recording operation. For this reason, in the series of processes illustrated in FIG. 4 or 5, the total discharging amount of ink in the flushing operation may be changed based on the time period from when the recording operation on the recording medium 12 (when the first path is started) to when the final path is finished. For example, the total amount of ink discharged is set relatively small in a case where the time is elapsed from when the first path is started or when the previous flushing operation is finished to when the next flushing operation is started (for example, when it is determined that the recording head is on the final path and that the stop position of the recording head 10 is on the side of the flush box 14) and the elapsed time is relatively short. In contrast, the total amount of ink discharged is set relatively large in a case where the elapsed time is relatively long. At this time, it is possible to change the total amount of ink discharged based on the comparison of a threshold value and the lapse of time by setting the threshold value with respect to the lapse of time in advance. In addition, the total amount of ink discharged during the flushing operation may be adjusted either by increasing and decreasing the number of times the ink is discharged or by increasing and decreasing the amount of ink per droplet, for example. In this manner, it is possible to restrict wasteful consumption of the ink in the flushing operation by making the total amount of ink discharged during the flushing operation changeable. The total amount of ink discharged during the flushing operation may be changed based on the amount of the recording data per sheet of the recording medium 12, for example. In this case, the total amount of ink discharged is set relatively small in a case where the amount of the recording data per sheet is relatively small. In contrast, the total amount of ink discharged is set relatively large in a case where the amount of the recording data per sheet is relatively large.

Needless to say, the invention is not limited to the example. As a matter of course to those skilled in the art, the following is disclosed as an example, which is: members, configurations and the like which could be replaced with one another disclosed in the example(s) are applied by appropriately changing the combination; members, configurations and the like that could be replaced with one another, but which are not disclosed in the example(s), are applied by being appropriately replaced with members, configurations and the like which are well-known techniques and are disclosed in the example(s) and by changing the combination; and members, configurations and the like that those skilled in the art could expect as an alternative for members, configurations and the like disclosed in the example based on the well-known techniques or the like although the former members and configurations are not disclosed in the example(s), are applied by appropriately replacing them with one another and by changing the combination.

The invention is not limited to the printer and can be applied to various ink jet type recording apparatuses such as a printer, a facsimile machine, a copying machine, and the like or liquid ejecting apparatus except for the recording apparatus, for example, a display manufacturing device, an electrode manufacturing device, chip manufacturing device, and the like, as long as they are liquid ejecting apparatuses that can execute the maintenance operation ejecting a liquid to a liquid receiving part separately from the liquid ejecting operation as the original use of the liquid ejecting apparatus. A solution of each coloring material of R (Red)•G (Green)•B (Blue) is ejected as a type of liquid through a coloring material ejecting head for the display manufacturing device. In addition, a liquid type electrode material is ejected as a type of liquid through an electrode material ejecting head for the electrode manufacturing apparatus, and a solution of a living body organic matter is ejected as a type of liquid through a living body organic matter ejecting head for the chip manufacturing device.

What is claimed is:

1. A liquid ejecting apparatus that executes liquid ejecting operation ejecting a liquid through nozzles of a liquid ejecting head onto a landing target while the liquid ejecting head scans in a first direction and the landing target is transported in a second direction substantially orthogonal to the first direction, wherein a liquid receiving part is disposed in an end portion in a movable range of the liquid ejecting head in the first direction and a maintenance operation ejecting a liquid through the nozzles toward the liquid receiving part is executed separately from the liquid ejecting operation, and wherein in a period between completion of a final scan of a first landing target and start of the liquid ejecting operation on a second landing target which is transported after the first landing target, the maintenance operation is executed when the liquid receiving part is positioned in a destination of the liquid ejecting head during the final scan of the first landing target and the maintenance operation is not executed when the liquid receiving part is not positioned in the destination of the liquid ejecting head during the final scan.

2. The liquid ejecting apparatus according to claim 1, wherein a total discharging amount of a liquid in the maintenance operation is changed according to the lapse of time from the completion of the previous maintenance operation to the start of the next maintenance operation.

3. The liquid ejecting apparatus according to claim 2, wherein the total discharging amount of a liquid in the maintenance operation is relatively small when the operation time is relatively short and the total discharging amount of a liquid in the maintenance operation is relatively large when the operation time is relatively long.

4. A method of controlling a liquid ejecting apparatus that executes liquid ejecting operation ejecting a liquid through nozzles of a liquid ejecting head onto a landing target while the liquid ejecting head scans in a first direction and the landing target is transported in a second direction substantially orthogonal to the first direction, wherein a maintenance operation ejecting a liquid through the nozzles toward a liquid receiving part disposed in an end portion in a movable range of the liquid ejecting head in the first direction is executed separately from the liquid ejecting operation, and wherein in a period between completion of a final scan of a first landing target and start of the liquid ejecting operation on a second landing target which is transported after the first landing target, the maintenance operation is executed when the liquid receiving part is positioned in a destination of the liquid ejecting head during the final scan of the first landing target and the maintenance operation is not executed when the liquid receiving part is not positioned in the destination of the liquid ejecting head during the final scan.

* * * * *